US011297405B1

(12) United States Patent
Iniguez

(10) Patent No.: US 11,297,405 B1
(45) Date of Patent: Apr. 5, 2022

(54) COMBINED AUTOMOBILE AND PORTABLE WIRELESS SPEAKER

(71) Applicant: Jampier Iniguez, Miami, FL (US)

(72) Inventor: Jampier Iniguez, Miami, FL (US)

( * ) Notice: Subject to any disclaimer, the term of this patent is extended or adjusted under 35 U.S.C. 154(b) by 0 days.

(21) Appl. No.: 17/203,100

(22) Filed: Mar. 16, 2021

(51) Int. Cl.
*H04R 1/02* (2006.01)

(52) U.S. Cl.
CPC ..... *H04R 1/025* (2013.01); *H04R 1/028* (2013.01); *H04R 2420/07* (2013.01)

(58) Field of Classification Search
CPC .... H04R 1/025; H04R 1/028; H04R 2420/07; H04R 2499/13; H04R 1/26
See application file for complete search history.

(56) References Cited

U.S. PATENT DOCUMENTS 5,864,627 A 1/1999 Kim
8,428,292 B2 4/2013 Shaffer
2009/0296955 A1* 12/2009 Shaffer ..... H04R 1/028 381/86
2017/0105069 A1* 4/2017 Mezzomo ..... H04R 1/026
2017/0251305 A1* 8/2017 Fathollahi ..... H04R 1/025
2020/0130603 A1* 4/2020 Berg ..... H04N 5/2252
2021/0237659 A1* 8/2021 Ludwig ..... H04R 9/022

* cited by examiner

*Primary Examiner* — Jason R Kurr
(74) *Attorney, Agent, or Firm* — Sanchelima & Associates, P.A.; Christian Sanchelima; Jesus Sanchelima

(57) ABSTRACT

A combined automobile speaker and portable blue tooth speaker including a disc shaped removable speaker located in a door of an automobile. The speaker further includes a clamp on a circular speaker holding bezel. The bezel is opened, and the speaker can be inserted or removed and is plugged into the automobile speaker sound system and can communicate with a portable audio player when removed. The rear end of the removable speaker includes a subwoofer component to enhance the listening experience of a user. The speaker may be removed and propped up via legs on the back end of the speaker device. This allows for a versatile and portable speaker that is integrated into the sound system of a vehicle or used independently.

15 Claims, 3 Drawing Sheets

COMBINED AUTOMOBILE AND PORTABLE WIRELESS SPEAKER

BACKGROUND OF THE INVENTION

1. Field of the Invention

The present invention relates to a portable speaker and, more particularly, to a combined automobile and portable wireless speaker that is disk shaped and removable mounted onto a car door to be integrated with the automobile's speaker system.

2. Description of the Related Art

Several designs for portable speaker have been designed in the past. None of them, however, include a combined automobile speaker and portable blue tooth speaker including a disc shaped removable speaker located in a door of an automobile. The speaker further includes a clamp on a circular speaker holding bezel. The bezel is opened, and the speaker can be inserted or removed and is plugged into the automobile speaker sound system and can communicate with a portable audio player when removed. The rear end of the removable speaker includes a subwoofer component to enhance the listening experience of a user. The speaker may be removed and propped up via legs on the back end of the speaker device. This allows for a versatile and portable speaker that is integrated into the sound system of a vehicle or used independently. It is known that individuals often have the need for a portable speaker to play audio media when in an outdoor setting. Therefore, there is a need for a portable speaker integrated into a car door to provide a versatile audio media device.

Applicant believes that a related reference corresponds to U.S. Pat. No. 8,428,292 issued for a portable powered speaker for an automobile which can connect to a portable audio player. Applicant believes that another related reference corresponds to U.S. Pat. No. 5,864,627 issued for an automobile audio system which can be powered by and operated in a vehicle and also removed from the vehicle and operated remotely. However, the cited reference differs from the present invention because they fail to disclose a combined automobile speaker and portable Bluetooth speaker comprising a disc shaped removable speaker located in a door of an automobile with a clamp on a circular speaker holding bezel.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a combined automobile and portable wireless speaker that is versatile and easy to use.

It is another object of this invention to provide a combined automobile and portable wireless speaker that is portable and seamlessly integrated into a vehicular speaker system.

It is still another object of the present invention to provide a combined automobile and portable wireless speaker that is portable and communicates with a mobile device to broadcast audio media.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
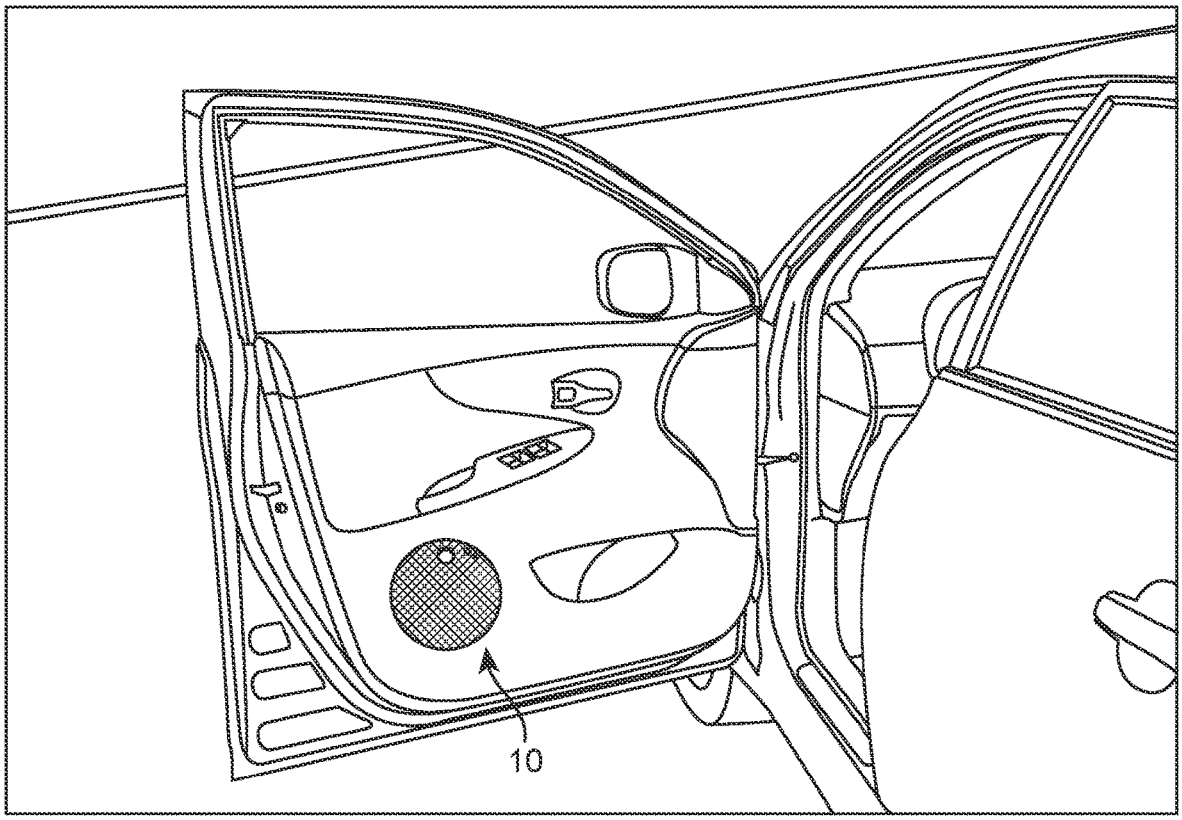
FIG. 1 represents an isometric operational view of the speaker system 10 in accordance with one embodiment of the present invention.

Referring now to the drawings, where the present invention is generally referred to with numeral 10, it can be observed that it basically includes a speaker system 10 which basically includes a speaker assembly 20 and a holder assembly 40.

Figure 2:
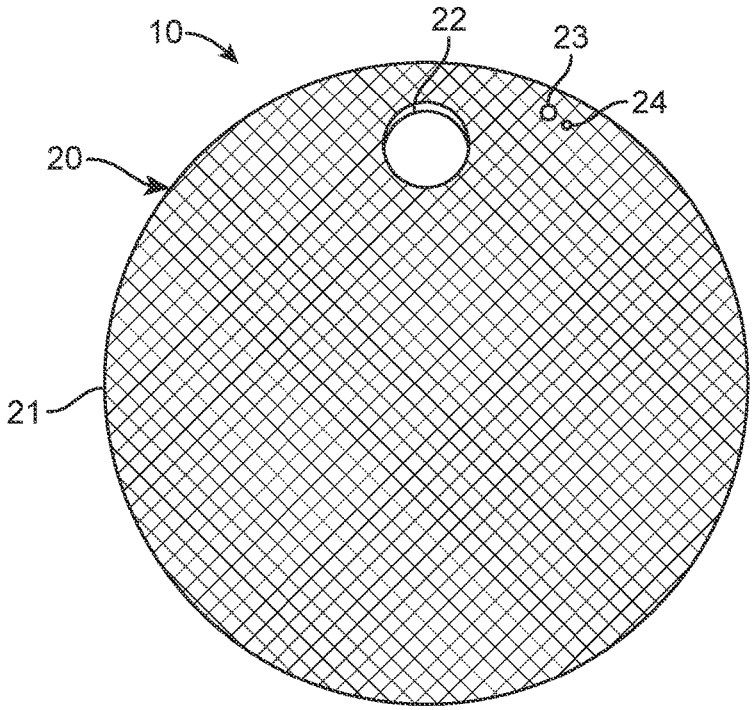
FIG. 2 shows a front view of speaker assembly 20 in accordance with an embodiment of the present invention.

Speaker assembly 20 includes a front operative side and a rear operative side. The front operative side includes a speaker 22 which may be observed in FIG. 2 of the provided drawings. In one embodiment, speaker 22 may be provided as having a circular shape with a speaker guard enveloping the entire front end. The speaker guard may be provided as a grated metal enclosure or cloth fiber enclosure, it should be understood that forms of speaker guards and designs may be implemented into the present system. Other embodiments of the invention may also feature speaker 22 having other shapes and is not limited to only being a circular shape. Speaker assembly 20 further includes a push button 23 positioned on the top end of speaker 22. Push button 23 may be actuated by a user in order to turn on and of the speaker system 10. Additionally, speaker assembly 20 further includes a charge indicator light 23 positioned along the periphery of the top surface of speaker 22. In one implementation charge indicator light 23 changes color in order to indicate if speaker assembly 20 is holding a charge or is low on battery. In one embodiment, speaker assembly 20 is powered by an internal battery that may be either wired or wirelessly charged. Furthermore, speaker assembly 20 includes a GPS module that wirelessly transmits a location of speaker assembly 20 to an external device. The external device may be represented as a mobile device which displays the location of the speaker 22. This prevents the user from losing the speaker when in its wireless operational environment.

Figure 3:
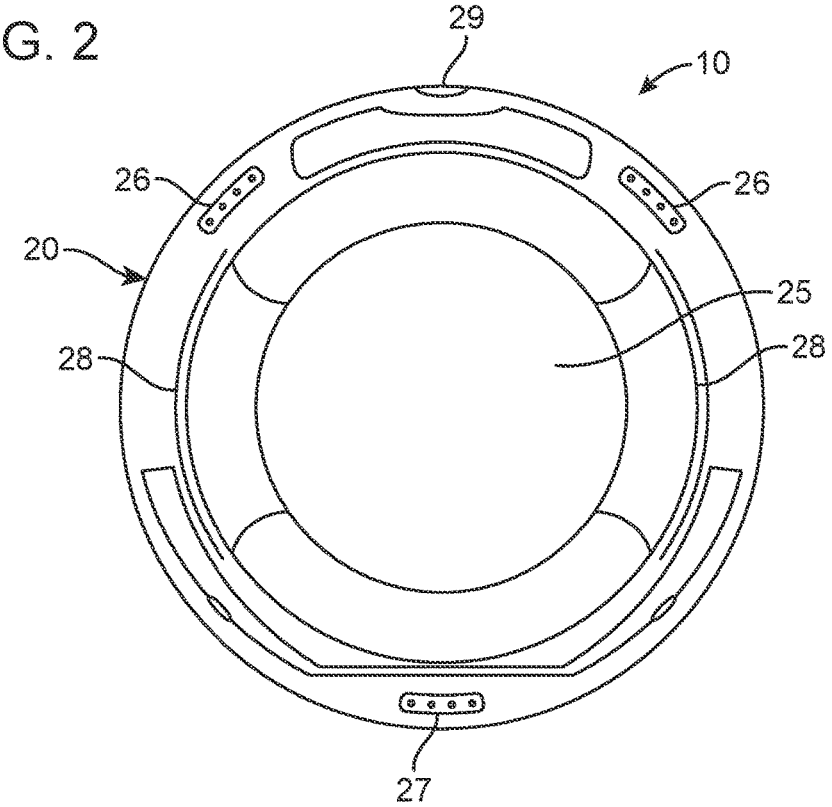
FIG. 3 illustrates a rear view of speaker assembly 20 in accordance with an embodiment of the present invention.

The rear operative side of speaker 22 comprises a subwoofer 25 positioned on a relatively center portion of the rear end as observed in FIG. 3 of the drawings. Subwoofer 25 broadcasts the lower frequencies of the audio media that is being streamed to the speaker assembly 20. In one embodiment, subwoofer 25 is provided a having a circular shape with a diameter that is less than that of speaker 22. It should be understood that any size and shape could be suitable for subwoofer 25. Additionally, the rear operative end of speaker assembly 20 includes sensor connectors 26 positioned along the outer periphery of the rear operative side. In the present implementation, sensor connectors operatively engage with holder assembly 40 in order to establish a secure connection with a vehicle. Furthermore, sensor connectors 26 may serve as a communication port for speaker assembly 20 to communicate with the speaker system that is integrated into the vehicle. As a result, when engaged with holder assembly 40, speaker 22 will broadcast media that is being streamed from the vehicle. Speaker assembly 20 further includes a charger port 27 on the rear operative side. Charger port 27 is also operatively connected to holder assembly 40 in order to supply charge to the battery. Furthermore, charger port 27 may be provided as a usb, usb-c, or any other type of charging connection port.

The rear operative side of speaker assembly 20 further comprises a ridges 28 which surround the subwoofer 25. In one embodiment ridges 28 are structural protrusions which engage with holder assembly 20 in order to form a secure attachment. Ridges 28 may either entirely surround subwoofer 25 or partially surround subwoofer 25. Furthermore, a clip 29 may be positioned along the outer perimeter edge of the rear operative side to further engage with holder assembly 40 for a more secure connection.

In one embodiment, the rear operative side of speaker assembly 20 further includes a grip portion and a retractable stand. In one implementation, the grip portion is provided as a hollow cavity that is formed within the rear operative side of the speaker assembly 20. A user may then insert their fingers partially within the grip portion in order to transport speaker assembly 20. Additionally, the retractable stand may be provided as a structural support member being hingedly coupled to the rear operative side of speaker assembly 20. A user may operatively engage the retractable stand in order to angle speaker assembly 20 in an appropriate position for broadcasting audio media.

Figure 4:
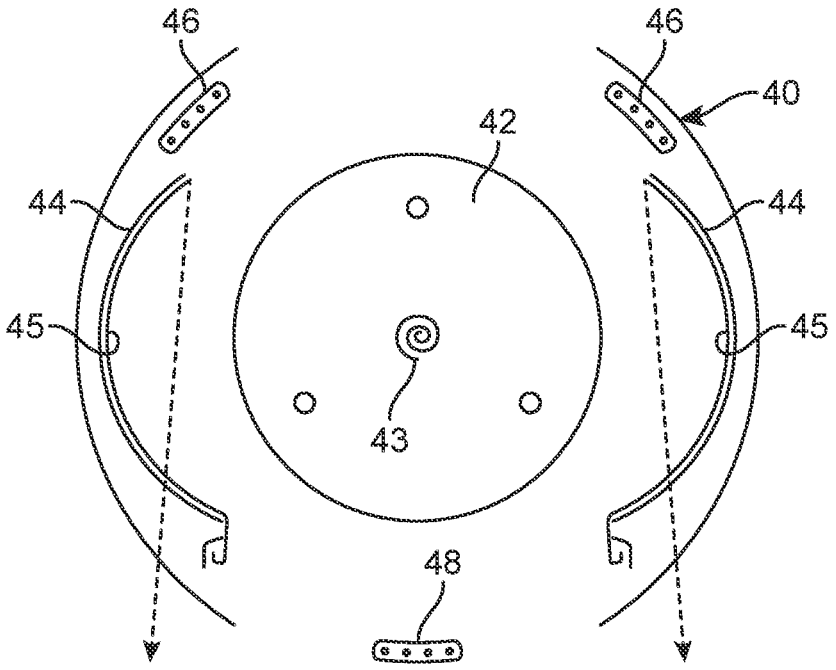
FIG. 4 is a representation of a front view of holder assembly 40 in accordance with an embodiment of the present invention.

Holder assembly 40 comprises a base 42 and a spring 43 as observed in FIG. 4 of the provided drawings. Holder assembly 40 is configured to be positioned along a car door for integration into a vehicle as observed in FIG. 1. Base 42 is provided as a circular member which is in abutting engagement with the door of the vehicle. Furthermore, spring 43 is positioned on a center portion of base 42 facing outwardly therefrom.

Holder assembly 40 further includes a bezel 44 which surrounds the outer perimeter of base 42. In one embodiment, bezel 44 is provided as semicircular structures which cooperate the shape of speaker assembly 20. Bezel 44 further includes bezel ridges 45 which line an inner portion of bezel 44. In the present embodiment, speaker assembly 20 is abuttingly engaged with holder assembly 40. Bezel ridges 45 then cooperate with ridges 28 in order to make secure contact. Further, spring 43 is abutting with the rear operative side of speaker assembly 20 when mounted thereon. Bezel 44 further includes sensor receivers 46 and a charger receiver 48 which are positioned to cooperate with sensor connectors 26 and charger connector 27 of speaker assembly 20. When speaker assembly 20 is engaged with holder assembly 40, sensor receivers 46 and charger receiver 48 make secure contact with the speaker assembly 20.

In the present implementation, holder assembly 40 is mounted within a vehicle. Speaker assembly 20 may then be mounted onto the holder assembly 40 to be operatively engaged with the vehicle. In this configuration, speaker assembly 20 is integrated with the vehicle such that any audio media being broadcasted from the vehicle is also being broadcasted from speaker assembly 20. In should be understood that a vehicle may include a plurality of speaker assemblies 20 therein. A user can then disengage speaker assembly 20 from the vehicle to be used in a wireless configuration. As a result, a user can operate speaker assembly 20 as a wireless speaker which may prove useful when playing music in an outdoor environment such as the par or the beach.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A combined automobile and portable wireless speaker, comprising:

a) a speaker assembly with a disc shape having a rear operative side and a front operative side, wherein said front operative side includes a speaker, wherein said rear operative side includes a subwoofer, wherein said rear operative side further includes sensor connectors, a charger port, and ridges along a peripheral edge of said subwoofer; and b) a holder assembly including a base and a spring, wherein said holder assembly further includes a bezel positioned along an outer perimeter area of said base, wherein said bezel is provided as semicircular structural members, said holder assembly further including bezel ridges, sensor receiver, and a charger receiver which operatively engage with the ridges, sensor connectors, and the charger port of the speaker assembly when mounted thereon.

2. The combined automobile and portable wireless speaker of claim 1 wherein said speaker includes a speaker cage.

3. The combined automobile and portable wireless speaker of claim 2 wherein said speaker cage is either a metal cage or a cloth mesh cover.

4. The combined automobile and portable wireless speaker of claim 1 wherein said speaker assembly is in communication with an external device to wirelessly receive audio media.

5. The combined automobile and portable wireless speaker of claim 1 wherein said holder assembly is operatively mounted to an automobile door, wherein said speaker assembly is in communication with an automobile speaker sound system.

6. The combined automobile and portable wireless speaker of claim 1 wherein said front operative side includes a push bottom to actuate said speaker assembly.

7. The combined automobile and portable wireless speaker of claim 1 wherein said front operative side further includes a charge indicator.

8. The combined automobile and portable wireless speaker of claim 1 wherein said front operative side further includes a GPS module.

9. The combined automobile and portable wireless speaker of claim 1 wherein said ridges are protruding structural members.

10. The combined automobile and portable wireless speaker of claim 1 wherein said rear operative side further includes a clip.

11. The combined automobile and portable wireless speaker of claim 1 wherein said rear operative side includes a grip portion, wherein said grip portion is a cavity.

12. The combined automobile and portable wireless speaker of claim 1 wherein said rear operative side further includes a retractable stand hingedly mounted thereon.

13. The combined automobile and portable wireless speaker of claim 1 wherein said base is circular in shape and said spring is positioned along a center portion of said base.

14. A combined automobile and portable wireless speaker, comprising:

a) a vehicle having a vehicle sound system and a door;

b) a speaker assembly with a disc shape having a rear operative side and a front operative side, wherein said front operative side includes a speaker, wherein said rear operative side includes a subwoofer, wherein said rear operative side further includes sensor connectors, a charger port, and ridges along a peripheral edge of said subwoofer, wherein said speaker assembly is in communication with an external device to wirelessly receive audio media, wherein said speaker includes a speaker cage; and c) a holder assembly including a base and a spring, wherein said holder assembly further includes a bezel positioned along an outer perimeter area of said base, wherein said bezel is provided as semicircular structural members, said holder assembly further including bezel ridges, sensor receivers, and a charger receiver which operatively engage with the ridges, sensor connectors, and the charger port of the speaker assembly when mounted thereon, wherein said base is abuttingly mounted to said door of said vehicle, wherein said speaker assembly is operatively communicated with the vehicle sound system via the sensor connectors.

15. A combined automobile and portable wireless speaker, consisting of:

a) a vehicle having a vehicle sound system and a door;

b) a speaker assembly with a disc shape having a rear operative side and a front operative side, wherein said front operative side includes a speaker, wherein said rear operative side includes a subwoofer, wherein said rear operative side further includes sensor connectors, a charger port, and ridges along a peripheral edge of said subwoofer, wherein said ridges are protruding structural members, wherein said speaker assembly is in communication with an external device to wirelessly receive audio media, wherein said speaker includes a speaker cage, wherein said speaker cage is either a metal cage or a cloth mesh cover, wherein said front operative side includes a push bottom to actuate said speaker assembly, wherein said front operative side further includes a charge indicator, wherein said front operative side further includes a GPS module, wherein said rear operative side further includes a clip; and c) a holder assembly including a base and a spring, wherein said base is circular in shape and said spring is positioned along a center portion of said base wherein said holder assembly further includes a bezel positioned along an outer perimeter area of said base, wherein said bezel is provided as semicircular structural members, said holder assembly further including bezel ridges, sensor receivers, and a charger receiver which operatively engage with the ridges, sensor connectors, and the charger port of the speaker assembly when mounted thereon, wherein said base is abuttingly mounted to said door of said vehicle, wherein said speaker assembly is operatively communicated with the vehicle sound system via the sensor connectors, wherein said rear operative side includes a grip portion, wherein said grip portion is a cavity, wherein said rear operative side further includes a retractable stand hingedly mounted thereon.

* * * * *